US006374563B1

(12) United States Patent
Erskine et al.

(10) Patent No.: US 6,374,563 B1
(45) Date of Patent: Apr. 23, 2002

(54) ANCHORING SYSTEM FOR CERAMIC LINING TILE

(75) Inventors: Charles P. Erskine, West Chester, PA (US); Keith E. Blair, Indian Mills, NJ (US)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/460,805

(22) Filed: Dec. 14, 1999

(51) Int. Cl.[7] ..... F27D 1/14

(52) U.S. Cl. ..... 52/506.03; 52/506.02; 52/506.06; 52/506.08; 52/385; 52/386; 52/387

(58) Field of Search ..... 52/391, 392, 479, 52/483.1, 762, 763, 761, 779, 506.06, 506.08, 384, 385, 386, 387, 389, 506.02, 506.03; 126/622

(56) References Cited

U.S. PATENT DOCUMENTS

| | | | | | |
|---|---|---|---|---|---|
| 1,723,500 | A | | 8/1929 | Campbell | |
| 1,879,459 | A | | 9/1932 | Pelton | |
| 1,891,511 | A | | 12/1932 | Venzie | |
| 3,930,916 | A | * | 1/1976 | Shelley | 156/71 |
| 4,170,859 | A | * | 10/1979 | Counihan | 52/763 |
| 4,488,389 | A | | 12/1984 | Farmont | 52/233 |
| 5,363,620 | A | * | 11/1994 | Liu | 52/482 |
| 5,373,676 | A | | 12/1994 | Francis et al. | 52/387 |
| 5,673,527 | A | * | 10/1997 | Coston et al. | 52/506.02 |
| 6,234,790 | B1 | * | 5/2001 | Van Laar et al. | 432/247 |

* cited by examiner

*Primary Examiner*—Carl D. Friedman
*Assistant Examiner*—Patrick J. Chavez
(74) *Attorney, Agent, or Firm*—Malcolm D. Keen

(57) ABSTRACT

An anchor rail and anchorage system for attaching ceramic refractory materials to a metallic substrate, or casing. Each anchoring rail (3) includes a web (9) and a retention structure. The retention structure of the rails includes a plurality of tabs (13) extending from the web to engage with alignment recesses on the edges of the tiles. The alignment structure on each tile (16) includes a slot (18) formed in each of two opposite sides of the tile (16). A method of building ceramic lined structures includes attaching an anchor rail (3) to a surface of the casing (5), fitting a row of tiles (4) in place with their alignment structures each fitting around the retention structures (13) of the anchor rail, and continuing on with another row of tiles, until a predetermined surface area of the structure is lined with tiles.

25 Claims, 8 Drawing Sheets

ANCHORING SYSTEM FOR CERAMIC LINING TILE

FIELD OF THE INVENTION

The present invention relates in general to anchoring systems, and more particularly, to an anchoring rail, and an anchorage system and method for attaching lining materials to a substrate or casing. Even more particularly, the present invention relates to an anchor rail and anchorage system for attaching and anchoring ceramic refractory tiles over a metallic process surface of a unit experiencing extreme service conditions, such as a fluidized catalytic cracking (FCC) cyclone or vessel.

BACKGROUND OF THE INVENTION

The use of refractory lining materials, such as monolithic ceramic materials, in high-temperature, severe duty environments is known throughout the petrochemical and refractory industries. For example, ceramics have been used in fluid catalytic cracking (FCC) air grid nozzles, cyclone dustbowls and diplegs, fluffing and stripping steam rings, catalyst withdrawal lines, and the like. They have also been used in burner throats and flue gas diversion tiles in fired heater applications. Erosion tests comparing ceramic materials to more conventional extreme service refractory have shown the ceramics to have about five to ten times, or better, abrasion resistance.

"Insert" installations, such as cyclone cones and diplegs, have presented minimal problems in field applications due in part to, for example, the fact that geometry tends to keep the materials in place, relatively small diameters, etc. However, equipment with larger diameters and flat sections have traditionally been more problematic. This is due in part to problems associated with different coefficients of thermal expansion of the materials of the equipment casing, the anchor, and the refractory tile.

Cyclone linings and other extreme service refractory installations in, for example, FCC units, typically consist of Resco AA-22S, manufactured by Resco Products, Inc. of Norristown, Pa., which is a phosphate-bonded refractory with hex mesh anchoring systems. Numerous alternative castable refractory materials (e.g., Harbison-Walker Coral Plastic, Plibrico Pliram, etc.) have been tested with generally successful results. Although existing lining technology (primarily hex mesh and AA-22S) is fairly simple to install initially, it is difficult and expensive to repair.

Other conventional techniques for attaching ceramic refractory tiles to metallic substrates include, for example, using single imbedded metallic clips welded to attachment studs, using central anchor rails, and using edge-clip/ship-lap designs. Single clip/stud anchoring methods provide a positive attachment but only at one central location for each tile. High tile costs favor using fewer, larger tiles. However, a large tile with a single, centrally located attachment point has several disadvantages. Central anchor rails mandate the ability to slide the tile down the length of the rail, which requires manufacturing tolerances higher than normally associated with fabricated structures. Designs requiring that the tile be able to slide down the length of the centrally located rail also introduce repair difficulties as well. Alternatively, studs protruding from the back of the central anchor rail could pass through holes formed in the metallic substrate. The studs could subsequently be welded to the back of the substrate by depositing weld material into the resulting annular hole. However, this is a difficult fabrication method.

Certain edge-clip/ship-lap designs offer the flexibility of placing a tile and then a clip and so on. However, the edge clip/ship-lap tile design is such that a single edge failure leads to catastrophic failure of the entire lining.

Accordingly, there is a need for a reliable, low-cost solution to the conventional anchor and anchorage system problems that is easy to manufacture, install, maintain, and repair. Similar needs are mirrored in other industries having extreme service processes, such as for example, the petrochemical, refractory, construction, and mining industries.

SUMMARY OF THE INVENTION

The above described problems associated with prior art devices and techniques for securely anchoring ceramic refractory materials to units experiencing extreme service conditions, such as a FCC cyclones or vessels, are overcome by the present invention. The solutions described herein are applicable in other industries in which a refractory and/or erosion lining is needed for use in equipment operating in relatively extreme operation conditions and extreme service locations.

The present invention is directed to an anchoring rail for attaching a ceramic refractory material having a slot formed in each of two opposite sides to a substrate or casing. The anchoring rail includes an elongated web and a retention structure extending from the web. A bottom edge of the web is attached to a process surface of the substrate or casing. Preferably, the retention structure includes a plurality of perpendicularly extending tabs extending from the web and are constructed to fit within and engage a corresponding alignment structure on the ceramic refractory material. Preferably, the tabs are formed extending outward from a top portion of the web alternating between a first direction and a second opposite direction. In addition, the tabs preferably extend in both the first direction and the second opposite direction in a plane that is substantially perpendicular to a plane defined by the web.

The anchor rail is preferably formed by cutting or punching a template of the rail from a piece of sheet metal and then forming the template such that the anchoring rail has a web and alternating perpendicularly extending tabs extending from the web. The tabs preferably have one of a square or a rectangular shape, although other shapes are possible, such as a semi-circular, an elliptic, a dovetail, etc. The bottom edge is constructed to attach to the inner surface of the substrate or casing. The anchor rails are preferably attached to the metallic substrate using conventional welding techniques, such as stitch welding. The preferred alternating recesses formed between tabs helps facilitate the attachment of the anchoring rail to the substrate by allowing a welding apparatus access to the bottom edge of the rail.

The present invention is also directed to an anchorage system for securely attaching lining materials, such as ceramic refractory tiles, to a metallic substrate or casing. The anchorage system includes an anchoring rail, as described herein above, a plurality of ceramic refractory tiles, and a substrate or casing of a unit, piece of equipment, or service location.

According to one embodiment of the invention, the anchor system includes a plurality of anchor rails that are used to attach a ceramic refractory material, such as a plurality of ceramic tiles, to a metallic substrate of casing, such as the inner wall of a FCC cyclone or vessel.

Preferably the substrate or casing is a metallic material. The substrate can include one of a shell, a pressure vessel, a cyclone body, an equipment working surface, an inner diameter, an outer diameter, or any other surface that is exposed to a process characterized by high temperatures and/or high erosion.

The lining material preferably includes a ceramic refractory material, such as ceramic refractory tiles. The anchorage system includes a plurality of tiles arranged adjacently and having an anchoring rail disposed therebetween to locate and anchor the tiles to the process surface of the substrate. The tiles have a top surface that is exposed to the process and a bottom surface that covers the process surface of the substrate. Each tile includes an alignment structure formed in each tile. Preferably, the alignment structure includes a plurality of slots formed in each of two opposite sides of the tile. The slots are formed to receive and connectively engage the tabs of the anchoring rails. Preferably, each slot is an elongated slot that is formed proximate the center of each side and runs substantially the longitudinal length of the tile.

The slots separate each side into an upper tongue and a lower tongue on each side of the tile. A relief notch can be formed on the lower tongue proximate the bottom surface. The relief notch provides a relief for the weld bead formed along the bottom edge of the anchoring rail. In addition, the lower tongue is preferably cut back a distance equal to about half the thickness of the web to allow a clearance for the thickness of the web and to allow the upper tongues of adjacent tiles to butt-up against one another.

In addition, a closing strip can be used to close the gap between the final tiles. The closing strip is preferably made from of a conventional refractory material, such as hex mesh and AA-22, or equivalent. Preferably, the closing strip is located in the least erosive area for the particular installation or service location.

A further embodiment within the scope of the present invention is directed to a method of anchoring a ceramic refractory material, such as a ceramic tile, to a process surface of a metallic substrate, or casing, such as a FCC cyclone or vessel, to form a ceramic lined structure. In a preferred embodiment, the method includes attaching metallic anchoring rails to the inner wall of a casing of, for example a FCC cyclone or vessel, and then attaching ceramic tiles to the anchoring rails to form a ceramic lining over the inner surface of the casing.

In another embodiment, the present invention includes a method of building ceramic lined structures in which the ceramic lining is structurally anchored to a metallic substrate, or casing. This method includes welding an anchor rail in place, fitting a tile in place with its edge fitting around the anchor rail, welding another anchor rail in place against the edge of the previously fitted tile, and continuing on with another tile, then a rail, then a tile, etc. until a predetermined surface area of the device is lined with tiles.

This method may preclude completing an entire circle around the inner circumference surface of a circular device. Accordingly, for devices having a circular shaped surface to be lined completely around its circumference, the final space between the first and last tile can be filled in with a closing strip of traditional refractory/anchorage system. Alternatively, the final tile may be slid into place on the first and final rail from the end. Preferably, the anchorage system of the present invention is used to line the most critical areas (e.g., those areas experiencing the most extreme operating conditions) of a particular piece of equipment and the traditional refractory/anchorage system is used in an area experiencing the least extreme conditions.

The lining method works equally well for new construction and repair areas during a plant shutdown. The design provides continuous anchorage along the edge of each tile while still allowing the metallic substrate to expand and slide relative to the ceramic tiles.

BRIEF DESCRIPTION OF THE DRAWINGS

The foregoing and other aspects of the present invention will become apparent from the following detailed description of the invention when considered in conjunction with the accompanying drawings. For the purpose of illustrating the invention, there is shown in the drawings embodiments that are presently preferred, it being understood, however, that the invention is not limited to the specific methods and instrumentalities disclosed. In the drawings.

DETAILED DESCRIPTION OF PREFERRED EMBODIMENTS

The present invention is directed to an anchoring rail and an anchorage system for attaching and anchoring a lining material to a substrate. The anchor rail and anchoring system would be useful in, for example, application areas where the lining material, such a ceramic tiles, are exposed to high temperatures, such as refractory applications, and/or where the tiles are exposed to high erosion, such as mining applications. The present invention also includes a method for forming ceramic lined structures in which the ceramic lining is structurally anchored to a structure substrate or casing.

Figure 1:
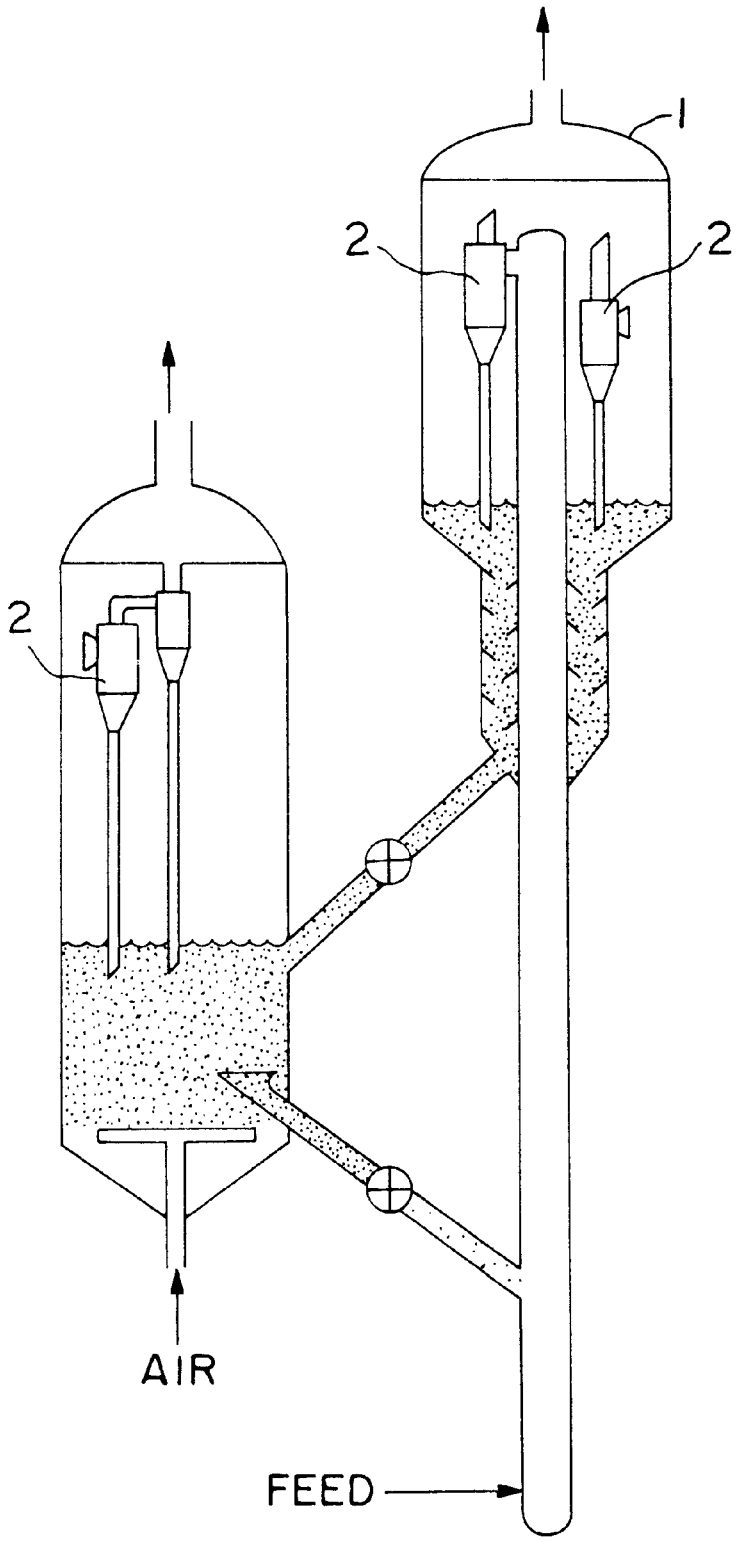
FIG. 1 shows an exemplary FCC unit in which the present invention may be used.

FIG. 1 shows an exemplary Fluid Catalytic Cracking (FCC) unit, such as that described in U.S. Pat. No. 5,057,205. As more fully described in that patent, the reactor 1 includes cyclones 2 which are lined with ceramic tiles that may be secured by the anchoring rails and anchorage system of the present invention.

Figure 2A:
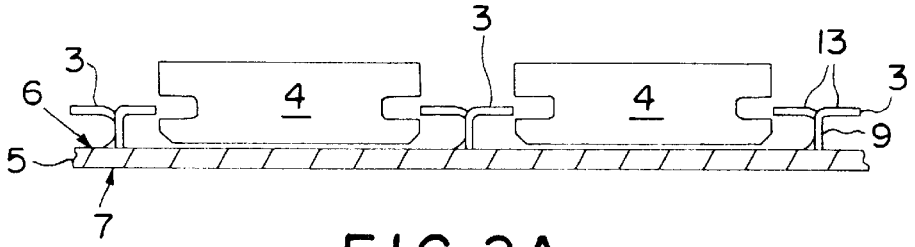
FIG. 2A shows side view of an exemplary anchorage system in accordance with the present invention.
Figure 2B:
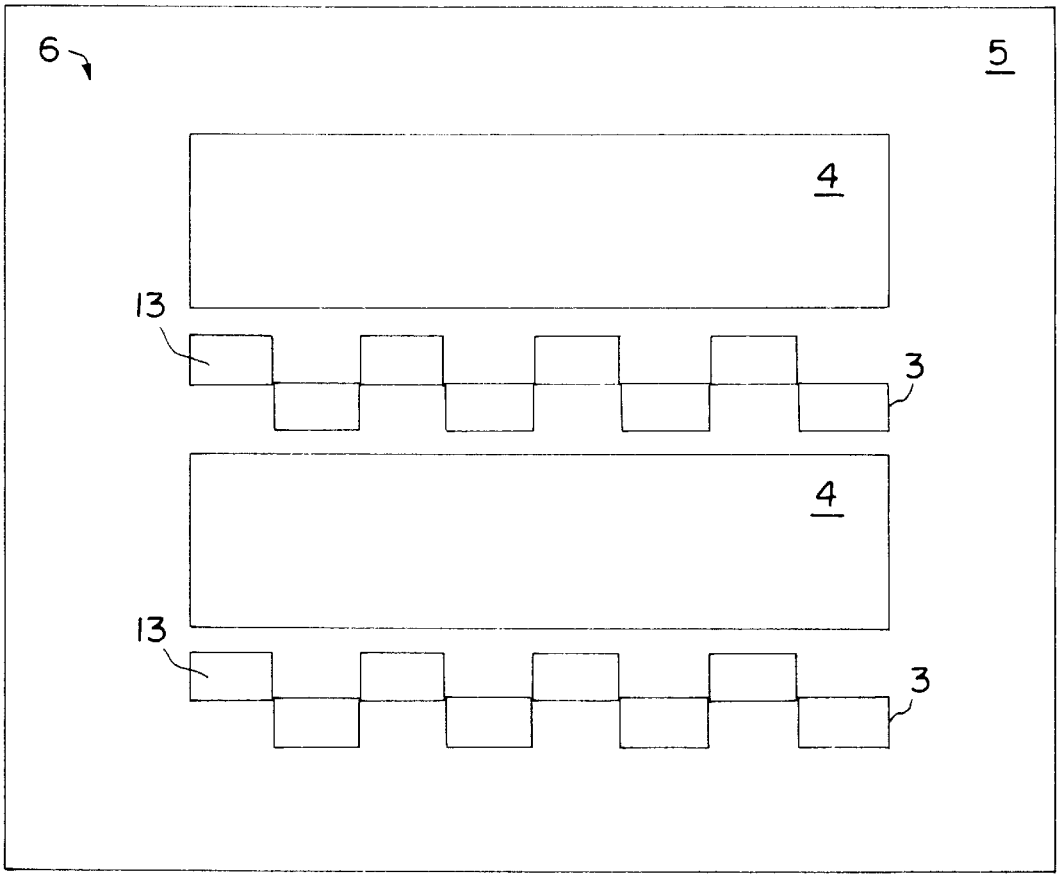
FIG. 2B shows a top view of the anchorage system of FIG. 2A.

FIGS. 2A and 2B shows an exemplary anchorage system having anchoring rails 3 for attaching a plurality of tiles 4 to a substrate 5 thereby forming a protective lining over the substrate 5. As shown in FIGS. 2A and 2B, each anchoring rail 3 is attached to the substrate 5 and the tiles 4 are attached to the anchoring rails 3 such that the anchoring rails 3 acts to locate and anchor the tiles 4 to the substrate 5.

The substrate 5 is preferably a metallic structure that is used in any of a number of harsh operating environments, including for example, locations and services having high temperature and high erosion processes. The substrate 5 can include a variety of structures, including for example, a plate-like structure, a pressure vessel, a casing, a shell, a cyclone body, an equipment working surface, etc. The substrate 5 structure can have a variety of shapes, including for example, a planar or dished shape, a curved surface, a spherical, a drum, an elliptical, or a conical shaped, etc.

FIG. 2A shows an exemplary flat-planar substrate having two surfaces. As shown in FIG. 2A, the two surfaces include a working or process surface 6 and a non-working surface 7. The anchoring rails 3 and tiles 4 of the anchorage system are attached to the substrate 5 such that the tiles 4 cover the working or process surface 6 of the substrate 5. The process surface 6 can include any surface of the substrate 5 that is exposed to a process, such as a high temperature or high erosion solid, liquid, or gas process. The process surface 6 can include, for example, an inner surface, an outer surface, an inner diameter, an outer diameter, one surface of the substrate, both surfaces of the substrate, etc. In addition, the anchoring rails and tiles can cover the entire process surface of the substrate, or, alternatively, only a portion of the process surface of the substrate that experiences harsh or extreme conditions.

Figure 3:
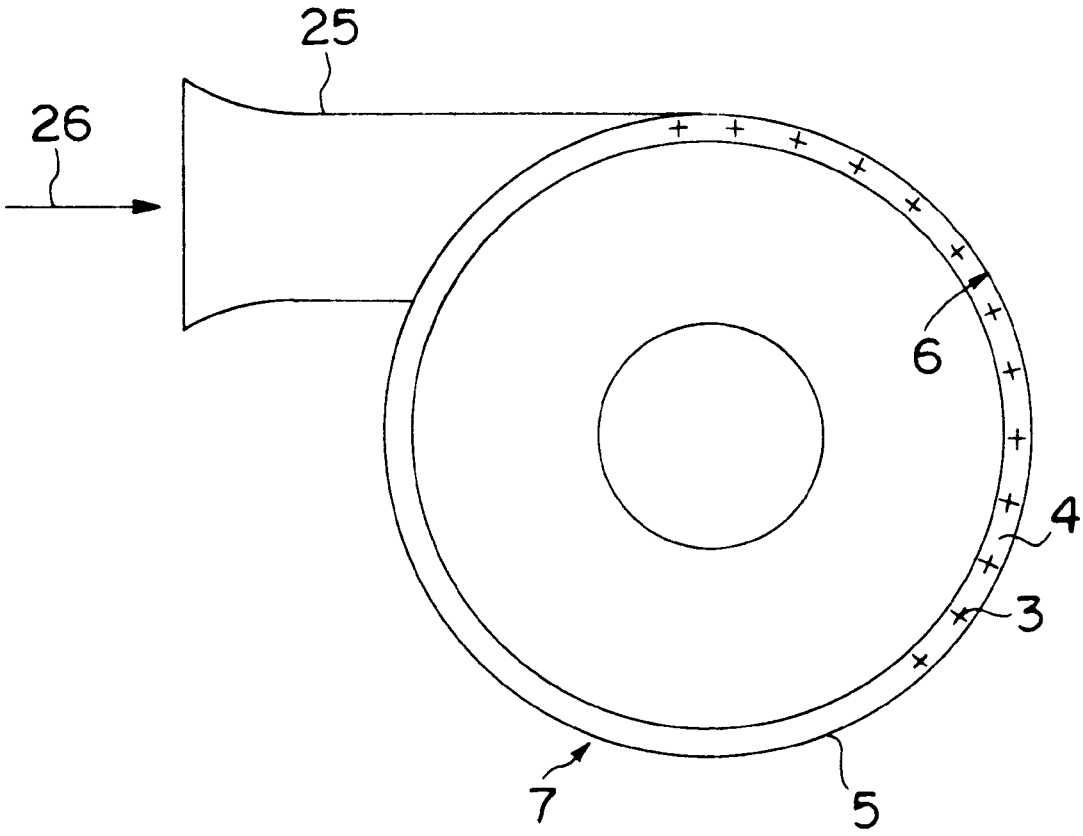
FIG. 3 is a top view of an exemplary FCC cyclone installation showing the layout of the anchorage system of FIG. 1 in accordance with the present invention.

FIG. 3 shows an exemplary layout of one embodiment of the anchorage system of the present invention for an exemplary installation in a primary fluid catalytic cracking (FCC) cyclone. As shown in FIG. 3, the flow of a high temperature, high erosion medium, such as a solid, liquid, and/or gas, enters an inlet 25 of the cyclone in the direction of arrow 26. Metallic anchoring rails 3 are attached to the inner wall surface 6 of the metallic cyclone casing 5. Ceramic refractory tiles 4 are held in place over the working or process surface 6 of the cyclone by anchoring rails 3 disposed along opposing sides 17*a*, 17*b* of each tile 4. As shown, the tiles 4 can form a protective lining over a predetermined area of the interior of the cyclone casing 5, which represents an extreme service location of the cyclone in the area of the incoming hot/erosive medium. The present invention provides a more robust anchorage system and improves the mechanical integrity of the attachment of the lining tiles 4 to the metallic cyclone casing 5 due to the strength of the connection of the rail to the substrate and the larger contact surface between the retention structure 10 of the anchoring rail 3 and the alignment structure 18 of the tile 4 which runs substantially along the longitudinal length of the tile. This results in a longer life expectancy for the anchorage system and thus a longer equipment life. The anchorage system of the present invention is also more commercially producible than other conventional anchoring techniques.

Figure 4A:
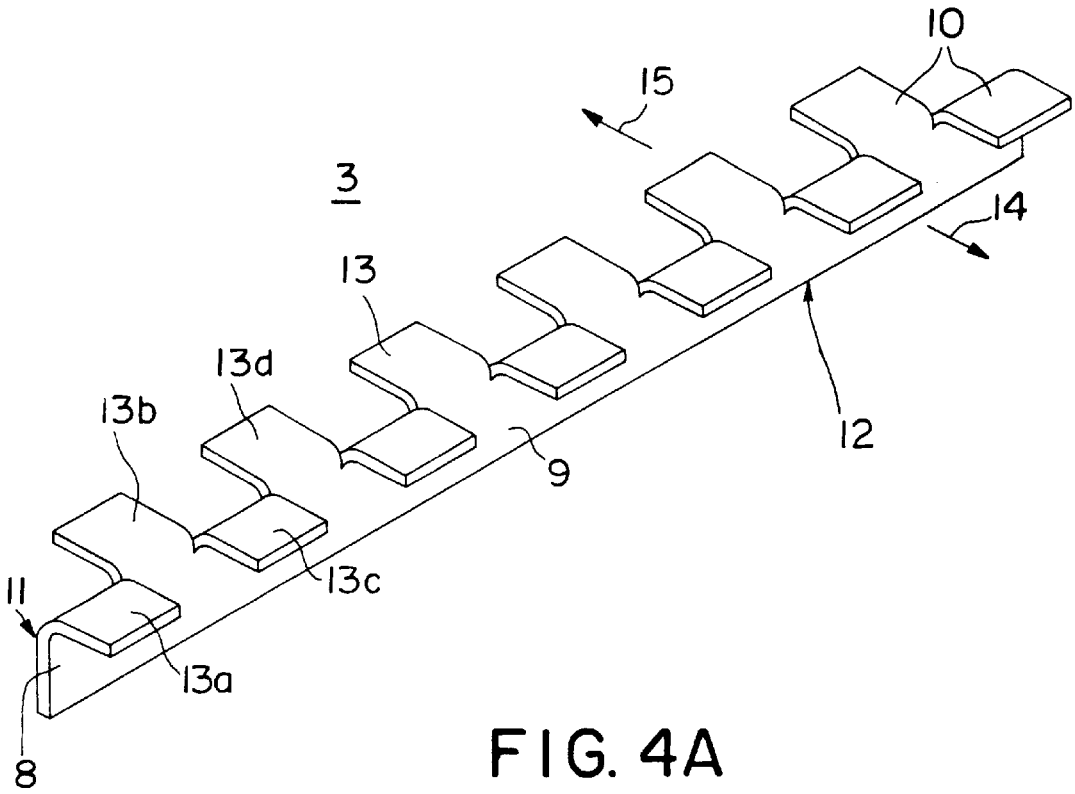
FIG. 4A is a perspective view of an exemplary anchor rail of FIG. 1.
Figure 4B:
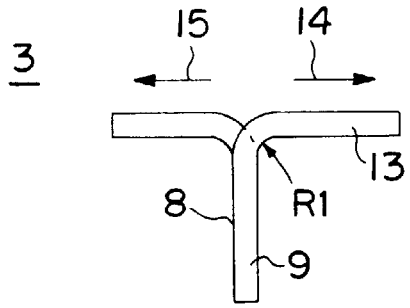
FIG. 4B is side view of the anchor rail of FIG. 4A.

FIGS. 4A and 4B show an exemplary anchoring rail 3 of the present invention for attaching a plurality of tiles 4 to a substrate 5. As shown in FIG. 3, the anchoring rail 3 includes an elongated T-shaped body 8 having a web 9 and a retention structure 10.

The web 9 includes a top portion 11 and a bottom edge 12. The bottom edge 12 is constructed for attachment to the substrate 5. Preferably, the bottom edge 12 is a flat planar edge that is disposed on the process surface 6 of the substrate 5 and then affixed to the substrate 5 by, for example, welding. This is generally the case even with circular or drum shaped device, because the rails 3 are preferably disposed so that their longitudinal lengths are parallel to the longitudinal length of the substrate or casing. Alternatively, the contour of the bottom edge 12 can be constructed to conform to the shape of the substrate surface 6 to which it will be attached.

The plurality of anchor rails 3 are arranged to cover the process surface 6 of the substrate 5 in a spaced apart relationship to one another and preferably conform to the shape of the substrate 5 to which the anchor rails 3 will be attached. For example, in an embodiment wherein the substrate is a concentric drum casing, the anchoring rail are preferably arranged such that the longitudinal length of each rail is parallel to the longitudinal axis of the drum and the rails are arranged around the drum in a parallel spaced-apart relationship to one another. Alternatively, in an embodiment wherein the substrate has a conical shape casing, the anchoring rails would be arranged tapering inward so that the ends of the rails at the top of the conical casing would be further apart then the ends of the rails nearer the narrow end of the conical casing.

Each anchoring rail 3 is attached to a surface 6 of the substrate 5 using standard techniques. Preferably the anchoring rail 3 is a metallic material and is attached to the metallic substrate 5 using standard welding techniques, such as stitch welding. Even more preferably, the anchor rails 3 are stitch welded along one side of the web to attach the anchor rail 3 to the process surface 6 of the substrate 5.

As shown in FIGS. 4A and 4B, the retention structure 10 extends outward from the top portion 11 of the web 9. Preferably the retention structure 10 includes a plurality of tabs 13 extending from a surface of the web 9 of each anchor rail 3. Preferably, the tabs 13 include a plurality of alternating perpendicularly extending tabs, as shown in FIG. 4A, that are formed extending from a top portion of the web alternating between a first direction (indicated by arrow 14) and a second opposite direction (indicated by arrow 15). For example, a first tab 13*a* extends from the web 9 in the first direction 14, a second tab 13*b* extends from the web 9 in the second opposite direction 15, a third tab 13*c* extends in the first direction 14, a fourth tab 13*d* extend in the second direction 15, etc.

Preferably, the anchor rail is formed by cutting or punching a template of the rail from a piece of sheet metal and then forming the template such that the anchoring rail has a web and alternating perpendicularly extending tabs extending from the web. This can be accomplished by bending the tab alternating between the first and second opposite directions. Preferably, a curved radius R1 is formed at the corner where each tab 13 extends from the web 9. The tabs 13 are constructed to fit within and connectively engage a corresponding alignment structure formed in the tiles 4.

Figure 4C:
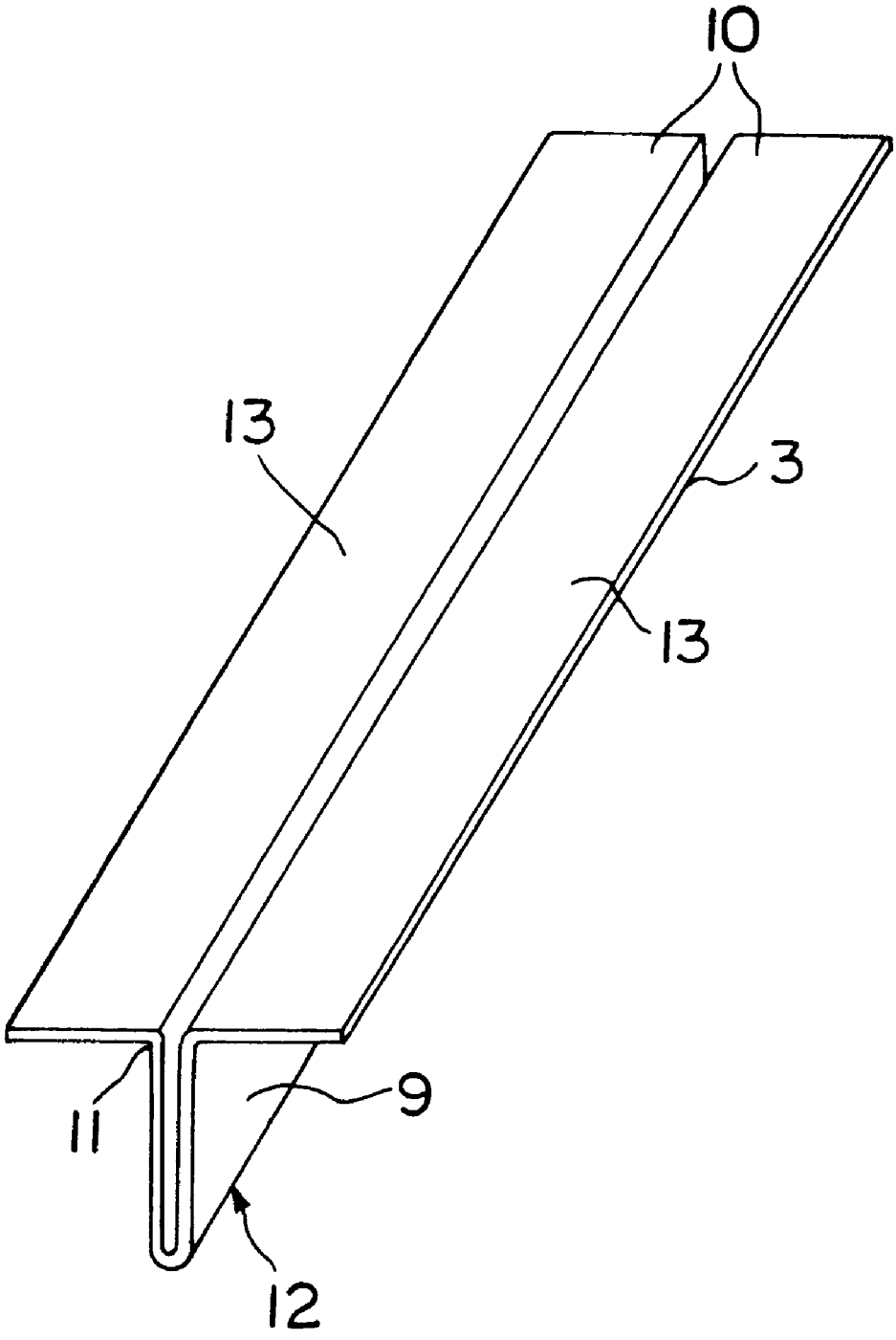
FIG. 4C is a perspective view of another exemplary anchor rail in accordance with the present invention.

FIG. 4C shows an alternative embodiment wherein the retention structure 10 includes two tabs having a length substantially equal to the length of the web 9 and extending in opposite directions in a plane substantially perpendicular to a plane formed by the web 9. As shown in FIG. 4C, the anchoring rail 3 can be formed from a single template using a forming process to bend the template into a T-shaped anchoring rail having a web 9 and two opposed tabs 13 extending from a top portion 11 of the web 9.

In addition, the tabs 13 preferably extend from the top portion 11 of the web 9 in a plane substantially perpendicular to a plane defined by the web 9 in both the first direction and the second opposite direction. Alternatively, for applications having larger tiles and where the substrate is not a flat planar surface, the tabs can be formed such that the tabs extend from the top portion in a plane substantially parallel to a plane defined by the process surface of the substrate.

The formation of a plurality of alternating tabs 13 is preferred because it allows for easier access to the bottom edge 12 of the rail 3 and facilitates the attachment of the rail 3 to the substrate 5 by allowing, for example, a welding rod electrode access to the bottom edge 12. The anchor rails 3 are preferably welded to the metallic substrate 5 with a small fillet weld (stitch welded) on only one side of the web 9. This may cause the rail 3 to rotate as the weld shrinks, but the rotation is slight and manageable considering the clearance between the rail tab thickness and the tile edge slot.

Figure 5A:
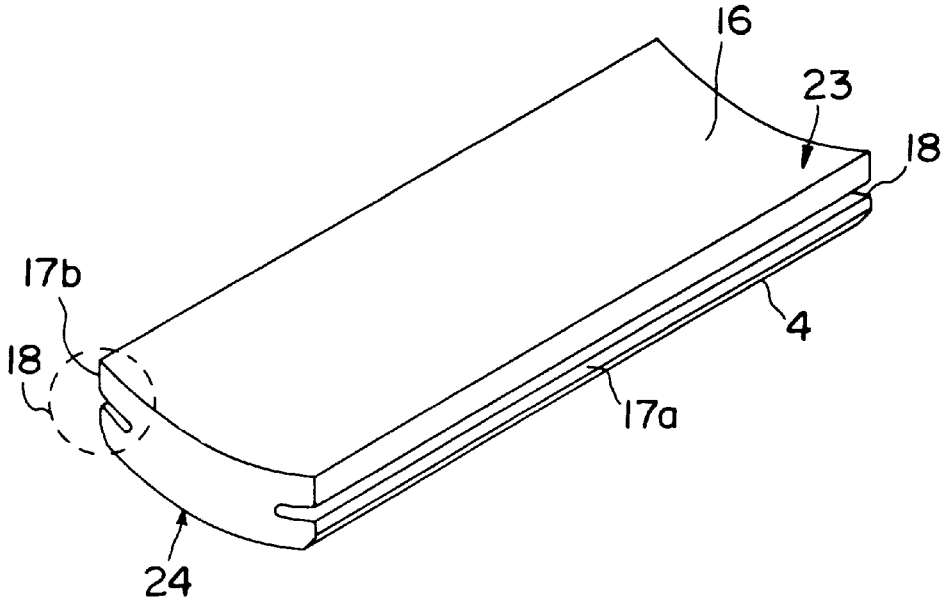
FIG. 5A is a perspective view of an exemplary tile of FIG. 1.
Figure 5B:
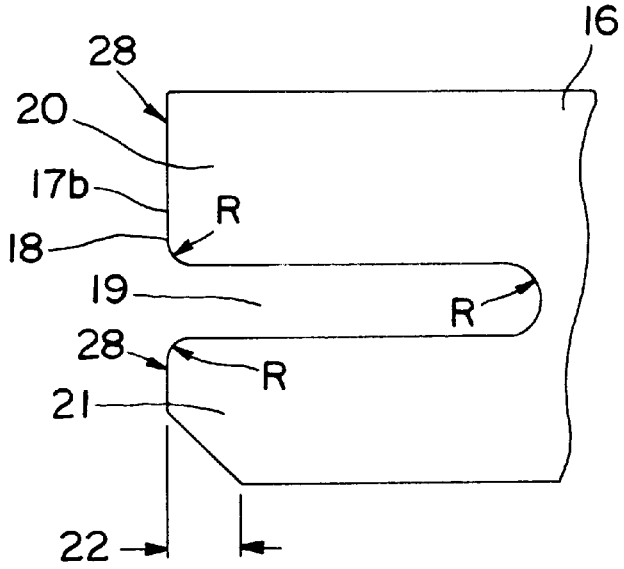
FIG. 5B is a detail view of one end of the tile of FIG. 5A.

The anchoring rail 3 preferably has an elongated design that can accommodate one or more tiles 4 along its longitudinal length. The longitudinal length of the anchoring rail 3 is predetermined based on the particular application and the length of the tile 4 that the anchoring rail 3 will be used to locate and support. Each anchor rail 3 is preferably fabricated from sheet metal allowing for ease of manufacturing at very low cost. The anchoring rails 3 are preferably, but not necessarily, formed by a forming process and do not require any machining to manufacture. For example, in one embodiment, a template of an anchoring rail is cut and/or stamped from a piece of sheet metal and the tabs are bent substantially perpendicular to the web alternating between the first direction and the opposite second direction. The anchorage system includes a plurality of tiles 4 arranged adjacently and having one of the anchoring rails 3 disposed therebetween thereby forming a lining over the process surface 6 of the substrate 5. As shown in FIGS. 5A and 5B, each of the tiles includes a body 16 having a top surface 23 that is exposed to the process and a bottom surface 24 that covers the process surface of the substrate 5. The tile body 16 includes two opposite sides 17*a*,17*b*, formed between and connecting the top surface 23 and the bottom surface 24. Each side 17*a*, 17*b* includes an alignment structure 18 formed therein corresponding to the retention structure 10 of the anchoring rails 3 for holding the tiles 4 together and anchoring the tiles 4 to the substrate 5.

As shown in FIG. 5A and in more detail in FIG. 5B, the alignment structure 18 preferably comprises one or more slots 19 formed in the sides of each tile. As shown in FIG. 5B, each opposite sides 17*a*, 17*b* of tile 4 has a single elongated slot 19 formed therein along the length of tile 4. Preferably, slot 19 is sized to receive the corresponding tabs 13 of the rails 3 thereby locating and anchoring the tile 4 to the rail 3 and on the substrate 5. The relatively large contact surface between the tabs 13 of each anchor rail 3 and the longitudinal slot 19 of each tile 4 is preferred to securely hold and anchor the tiles to the process surface 6 of the substrate 5.

The slots 19 are formed to cooperate with the tabs by receiving and connectively engaging the corresponding tabs of the anchoring rail. As shown in FIG. 5A, each slot 19 is preferably formed in the center region of each side 17*a*, 17*b* and runs the longitudinal length of the tile 4. Preferably, the slots 19 and the tabs 13 form an interference fit. The tile 4 geometry, as shown in FIGS. 5A and 5B, assists in holding the tiles in place over the process surface. The flat ends 28 of each tile 4 are wedged against the flat ends 28 of adjoining tiles 4 and this assists in holding and anchoring the tiles 4 in place.

In addition, the anchorage system preferably provides a clearance between the slots 19 and the tabs 13. This clearance is sized based on the application and relative sizes of the components to allow for slight relative movement between the tiles 4 and the rails 3 as the components expand and contract during operation due to differences in the coefficients of thermal expansion of each component. However, the clearance is not too large as to allow the tiles to vibrate or rattle around during operation.

The tiles 4 include an upper tongue 20 and a lower tongue 21 that are formed on each side 17*a*, 17*b* and separated by slot 19. Preferably, the corners around each slot 19 (e.g., at the bottom of the slot 19 and the corners formed between the slot 19 and upper and lower tongues 20, 21) are formed having a radius R (e.g., rounded corners). These rounded corners facilitate locating the tiles over the rails and also allow for slight movement between the tiles and the rails during operation. Each tile 4 can include one or more relief notches 22 formed where the bottom surface 24 and one or both of the sides 17*a*, 17*b* meet. Each relief notch 22 provides a clearance for the point of attachment of the rail 3 to the substrate 5. For example, where the rail is welded to the substrate, the relief notch provides a clearance for the weld bead to fit within thereby providing a tighter fit between adjacent tiles. The size of the relief notch depends on the particular application and the method of attaching the rail to the substrate.

Figure 5C:
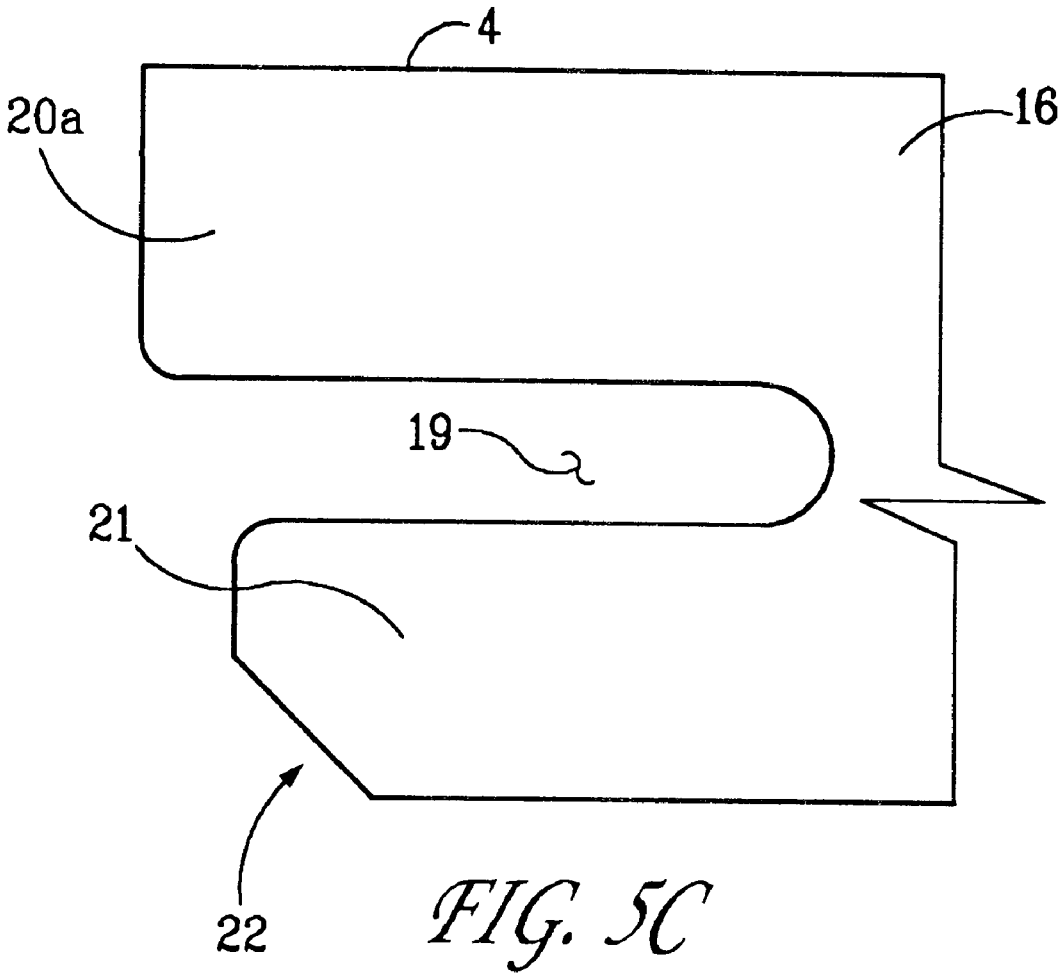
FIG. 5C is a detail view of an end of another exemplary tile in accordance with the present invention.

In addition, each tile 4 can be formed having an extended upper tongue 20*a*, as shown in FIG. 5C. The extended upper tongue 20*a* overhangs, or extends out further than, the lower tongue 21. This is preferably accomplished by cutting back the lower tongue 21 of the tile 4. Preferably, the extended upper tongue 20*a* extends out a distance equal to about one half the thickness of the web 9 (e.g., the cut back equals about one half the thickness of the web). This provides a clearance for the thickness of the web 9 between adjacent tiles 4 thereby providing a tighter fit between adjacent tiles on the surface exposed to the process.

Preferably, a machining process forms the slots 19. The tiles can be formed without the slots and then the slots 19 can be machined into each side 17*a*, 17*b* of the tile. This machining is a specialized, but repetitive process. Alternatively, the slots can be formed during the molding of the tile. The dimensions of the slots depend on the dimensions of the tiles and the particular application. For example, the thickness of the slot preferably increases as the thickness of the tile increases and the depth of the slot preferably increases as the width of the tile increases. Preferably, the size of each slot 19 is minimized in order to maximize the amount of area that is tile and to minimize the amount of area that has the rail tab. It is desired to keep the aspect ratio low in order to avoid a high bending ratio. This makes the tiles more robust.

The lining material preferably includes a ceramic refractory material, such as ceramic refractory tiles. The material of the tiles 4 depends on the particular application and process that the anchoring system is being used in. For example, in an exemplary high temperature and high erosion fluid catalytic cracking cyclone, the tiles are made from a ceramic refractory material. Also, the shape of the tiles also depends on the particular applications, as well as the shape and configuration of the substrate 5.

WORKING EXAMPLE

Figure 6:
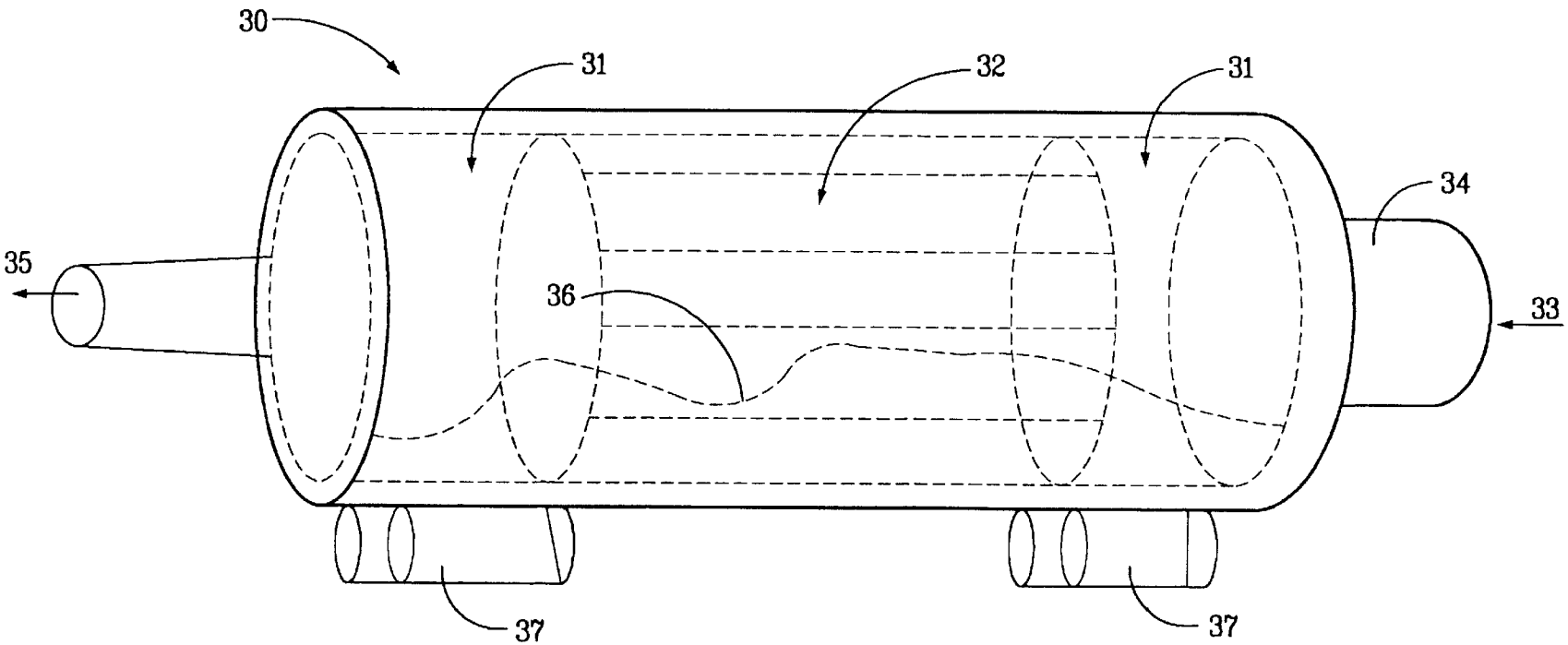
FIG. 6 is a block diagram showing an exemplary rotating drum assembly used to test the anchorage system of FIG. 1.

FIG. 6 shows a thermal cycling, catalyst filled, rotating drum assembly 30 that was used to test the anchor rail/tile edge anchorage system of the present invention. Following ten thermal cycles to 1750° F. the ceramic tiles 4 were found intact and firmly secured to the inner surface 6 of the drum wall 5. The test focused on ceramic refractory materials and anchoring systems for use in FCC cyclones, and other extreme service locations. The test was concerned with the mechanical integrity of the installation as opposed to quantitative evaluation of erosion resistance. The ceramic lining off material included 1-inch thick Alanx composition 2K+ manufactured by Alanx Wear Solutions, Inc. The Alanx material is a ceramic/metal composite. The Alanx installation performed well, due in part, as a result of the improved anchor design, thicker tiles, and observed greater physical strength and toughness of the anchorage system.

The objective of this project was to test various tile and anchoring systems in an environment that simulates severe thermal cycling, vibration and catalyst contact. The performance of the anchoring rails and the anchorage system was evaluated based on ease of installation and their relative mechanical integrity during and after thermal cycling.

FIG. 6 shows the test apparatus which included a 36-inch diameter rotating drum lined with a conventional lining material 31, which for this test was hex mesh and Resco AA-22S refractory, at each end and a plurality of adjacently arranged new tiles 4 and anchoring rails 3 for a 13-inch wide center ring area 32. The assembly 30 was heated from an inlet end 34 with an internal gas-fired tube 33 (e.g., a burner), with exhaust exiting the opposite end 35. The drum was partially filled with catalyst 36 and continuously rotated using roller 37 coupled to a motor (not shown) to simulate catalyst migration of catalyst into gaps and cracks, which has been shown to have significant negative effect on refractory systems.

During the re-assembly of the rotating drum assembly 30 with the ceramic tiles 4 installed in the center region 32 of the drum casing, retaining rings 38 were installed between the new ceramic tiles 4 and the conventional castable refractory material 31. The dimensions of the tiles depend on the particular application and the size of the substrate or casing being covered. Preferably, the tiles are sized to be large enough to cover the process surface quickly, and at the same time small enough to handle conveniently in the shop or field. Details and exemplary dimensions of the new tiles 4 for the rotating drum assembly having a 36 inch diameter shell were a length L of about 13 inches, a width W of about 3 inches, and a height H of about 1 inch. The new anchoring rails were made from 14 GA. 304SS material. Details and exemplary dimensions of the new anchoring rails 3 were a length L of about 13 inches, a width W of about ¾ inch, a height H of about 7⁄16 inch, and a tab length of about 1 inch.

In the assembly sequence of the rail-tile-rail-tile-etc. in accordance with the present invention, the rails were attached by about three or four stitch welds about 1-inch in length on one side of each rail 3. This caused the rails 3 to rotate slightly toward the weld side during cooling. However, this did not present a problem since the clearance machined slot 19 in the tile 4 is large enough to accommodate the rotation, but not so large as to create sloppiness in fit-up.

The last section between the first and the last tiles was filled with a closing strip, or patch, since exact fit-up of tiles was not achieved, and the anchor welds could not be made for the last tile with a tile in place. Preferably, the closing strip includes a castable refractory material, such as hex mesh and AA-22 manufactured by Resco Products, Inc. of Norristown, Pa., or equivalent, and is installed using conventional techniques. Preferably, the tabs of the first and last anchor rail preferably extend some distance into the adjoining biscuit of the conventional castable refractory material. The location of the castable patch or closing strip should be located in a less erosive area for the particular installation or service location.

The assembly 30 including the anchorage system of the present invention was thermally cycled ten times from ambient conditions to about 1700° F. and back. The new anchor rails and the 1-inch thick Alanx tiles were heated and cooled their full complement of 10 cycles, with only one tile showing slight transverse cracking, and none falling out.

An exemplary method of assembling the lining material over a process surface of a substrate is as follows: welding an anchor rail having a retention structure formed thereon in place on the process surface of a substrate; fitting a tile having a corresponding alignment structure in place with its alignment structure fitting around the retention structure on the first anchor rail; welding another anchor rail having a retention structure in place against the free side of the previously fitted tile such that the retention structure fits within and engages the alignment structure of the previous tile; continuing on with another tile, then a rail, then a tile, etc.

For applications having a circular, drum, or conical shape process surface, this method may preclude completing an entire circle. For these type of installation, a closing strip can be used to fill the final space between the first and last tile. Preferably, the closing strip includes a traditional refractory/anchorage system installed using conventional techniques. Alternatively, the last tile may be slid into place from the end such that the alignment structure on each side of the tile slide over and engage the retention structure of the first and last rail. The anchorage system of the present invention is intended to line at least the most critical areas of a particular piece of equipment.

The lining method of the present invention works equally well for new construction and repair areas during, for example, a plant shutdown. The design of the anchorage system and method of the present invention provides continuous anchorage along the edge of each tile while still allowing the metallic substrate to expand and slide relative to the ceramic tiles.

The use of the anchoring rail and anchorage system for locating and attaching ceramic refractory materials to a substrate, or casing and the described method of building ceramic lined structures in which the ceramic lining is structurally anchored to the casing provide for the following advantages:

(1.) This technology can be used to fabricate partially ceramic lined cyclones and equipment for use in FCC Units or any other equipment requiring erosion, corrosion, and/or high temperature resistant linings. In FCC Units, for example, ceramic lined cyclones would provide approximately ten times greater, or better, erosion resistance over the best current lining systems. This would reduce the need and/or frequency for cyclone repair or replacement. In addition, greater erosion resistance allows for higher cyclone gas/solids velocities and mass flow rates, and therefore allows greater unit throughput without increasing the physical size of the unit.

(2.) This technology to rebuild or upgrade existing FCC units that are currently limited by the size of their cyclone containing pressure vessels. This technology would also have importance in gaining greater cyclone erosion resistance. This technology could be used throughout many different industries in numerous situations requiring protective ceramic linings.

Although illustrated and described herein with reference to certain specific embodiments, it will be understood by those skilled in the art that the invention is not limited.

What is claimed is:

1. An equipment item for use in a high temperature severe duty environment having a protective lining comprising ceramic refractory tiles attached to a substrate by means of an anchorage system, mountable on the substrate to form the protective lining over said substrate, said anchorage system comprising:

a plurality of spaced apart anchor rails attached to said substrate, each of said anchor rails having a retention structure formed thereon; and a plurality of ceramic refractory tiles arranged adjacently between adjacent spaced apart rails and having one of said anchoring rails disposed between tiles, each of said tiles including a body having two opposite sides, each side having an alignment structure formed therein corresponding to said retention structure for securing said tiles to the anchor rails to anchor said tiles to said substrate.

2. The equipment item of claim 1, wherein said retention structure of the anchor rails comprises a plurality of tabs extending from each of said anchor rails and said alignment structure of the tiles comprises a plurality of slots formed in each of said tiles, wherein said tabs cooperate with said slots to locate and anchor said tiles with respect to said substrate.

3. The equipment item of claim 2, wherein said plurality of tabs comprise a plurality of tabs extending perpendicularly from a top portion of a web of each of said anchoring rails.

4. The equipment item of claim 3, wherein said tabs comprise a plurality of tabs extending in alternating manner perpendicularly from the top portion of the web of each of the anchoring rails, wherein said tabs extend alternately between a first direction and a second opposite direction along a longitudinal length of said anchoring rail.

5. The equipment item of claim 2, wherein said tabs extend from said web in a plane substantially perpendicular to a plane defined by said web in both said first direction and said second opposite direction.

6. The equipment item of claim 2, wherein said plurality of slots comprises one elongated slot formed in each of two opposing sides of each of said tiles.

7. The equipment item of claim 1, wherein said retention structure of the anchor rails and said alignment structure of the tiles extend in a plane substantially perpendicular to a plane defined by a web of said anchoring rail.

8. The equipment item of claim 1, wherein said retention structure of the anchor rails and said alignment structure of the tiles extend in a plane substantially parallel to a plane defined by a process surface of said substrate.

9. The equipment item of claim 1, wherein said anchor rails comprise a metallic material.

10. The equipment item of claim 1, wherein said substrate comprises a metallic material.

11. A method of building a protective lining in a vessel for use in a high temperature severe duty environment, the lining comprising ceramic refractory tiles structurally anchored to a casing of the vessel comprising:

(a) attaching a first anchor rail to a process surface of said casing;

(b) fitting a first ceramic tile to said anchoring rail;

(c) fitting a second anchor rail to an opposite side of said ceramic tile of step (b);

(d) attaching said second anchor rail from step (c) to said process surface of said casing;

(e) fitting another ceramic tile to said second anchor rail of step (d); and (f) repeating steps (c) through (e) until said ceramic tiles cover a predetermined area of said process surface of said casing.

12. The method of claim 11, wherein said attaching of said anchor rail to said process surface comprises attaching a bottom edge of a web of each rail to said process surface of said casing.

13. The method of claim 10, in which the bottom edge of each rail is attached to said process surface of the casing by welding.

14. The method of claim 11, in which each anchor rail comprises a web and a retention structure, wherein said web is formed having a bottom edge and a top portion, and wherein said retention structure is formed extending from said top portion of the web in a plane substantially perpendicular to a plane formed by said web.

15. The method of claim 14, said retention structure comprises a plurality of tabs extending from the top portion of said web alternating between a first direction and a second opposite direction from the plane of the web.

16. The method of claim 11, in which each of said tiles has an alignment structure corresponding to and cooperating with said retention structure of said anchor rails for locating and anchoring said tiles over said process surface of said casing.

17. The method of claim 16, in which said alignment structure comprises an elongated slot along two opposed sides of each of said tiles.

18. The method of claim 17, in which said elongated slot is machined into each of the two opposed sides of said tiles.

19. The method of claim 11, in which the protective lining comprises a plurality of tiles attached to the casing and arranged in a circle with a first tile and a last tile in each circle which do not complete an entire circle, the method further comprising installing a closing strip between said first tile and the last tile of the circle.

20. The method of claim 19, in which each anchor rail comprises a web and a retention structure, in which the web is formed having a bottom edge and a top portion, with the retention structure formed extending from the top portion of the web in a plane substantially perpendicular to a plane formed by said web, the retention structure of said first anchor rail extending in a direction away from said tiles in the circle of tiles and the retention structure of a last anchor rail extending in a direction away from said tiles into said closing strip.

21. The method of claim 11, wherein said structure is a cyclone of a FCC unit.

22. The method of claim 19 in which the first tile and the last tile of each circle of tiles is attached to the casing by means of an anchor rail on each of two opposed sides of the tiles.

23. The method of claim 19 in which the closing strip is formed of a castable refractory material formed with the retention structure of the first and last anchor rails extending into the castable refractory material.

24. The method of claim 20 in which the retention structure on each anchor rail comprises a plurality of tabs extending perpendicularly from a top portion of a web of each of the anchor rails.

25. The equipment item of claim 1 which is a vessel having a metallic casing to which the interior process surface of which the protective lining is attached.

* * * * *